United States Patent [19]

Coster

[11] 4,045,013

[45] Aug. 30, 1977

[54] MARKER BOARD

[76] Inventor: Theo M. S. Coster, Beyt Horon Street 7, Tel Baruch, Israel

[21] Appl. No.: 503,307

[22] Filed: Sept. 5, 1974

[30] Foreign Application Priority Data

Jan. 22, 1974 Israel ..... 44054

[51] Int. Cl.[2] ..... A63F 3/00

[52] U.S. Cl. ..... 273/136 F; 116/130; 273/136 GA

[58] Field of Search ..... 273/130 R, 135 BC, 136 F, 273/136 G, 136 GA, 148 R; 116/120, 130

[56] References Cited

U.S. PATENT DOCUMENTS

| | | | |
|---|---|---|---|
| 2,872,215 | 2/1959 | Taylor | 273/136 G X |
| 3,456,948 | 7/1969 | Bosco | 273/136 F |
| 3,823,944 | 7/1974 | Stubbmann | 273/136 F |

FOREIGN PATENT DOCUMENTS

| | | | |
|---|---|---|---|
| 70,217 | 11/1949 | Denmark | 273/136 F |

*Primary Examiner*—Anton O. Oechsle
*Attorney, Agent, or Firm*—Pennie & Edmonds

[57] ABSTRACT

A marker board and a method for making same which board embodies a frame structure that defines the spatial extent of the board, an array of annular bar rings forming at least a part of the frame, and a plurality of flexible shells, each having peripheral base portions integrally formed with the rings and being independent and reversibly invertible with respect to the frame.

2 Claims, 5 Drawing Figures

MARKER BOARD

BACKGROUND OF THE INVENTION

This invention relates to a marker board and method of making same. As used in this specification, the term "marker board" refers to a board or the like having means for forming, simultaneously or successively, visually observable, removable markings whose number and/or disposition can be readily altered and which provides an instantaneous indication of state. Thus, the board can be a game board with which a game, which would normally involve the movement of pieces, can be played with the moves being effected by forming and/or removing one or more such markings. Alternatively, the board can, for example, be used as a score board in which case the forming or removal of markings serves to reflect a change in the score while the appearance of the board at any particular time gives an instantaneous indication of the score.

SUMMARY OF THE INVENTION

It is an object of the present invention to provide a new and improved marker board and method of making same.

According to the present invention there is provided a marker board essentially comprising:

a. a frame structure defining the spatial extent of the board;

b. an array of annular base rings forming at least part of the frame structure;

c. a plurality of flexible shells;

d. peripheral base portions of the shells formed respectively integrally with the rings, the shells being independently and reversibly invertible with respect to the frame structure; and e. tip portions of the shells located within said spatial extent.

With such a marker board the exertion of an axially directed pressure on the outer surface of the tip portion of any shell causes the shell to invert and thus a marking is effected. The structural relationship of the shells with their annular base rings, the latter being either rigid or being in any case of much lower flexibility than the shells ensures that the inversion of any particular shell does not effect the disposition of adjacent shells. Furthermore, by virtue of the fact that the tip portions of the shells are all located within the spatial extent defined by the frame structure of the board, it is ensured that, when the board is located on a support surface, such as, for example, a table, the contact of the frame structure with the table is such as to ensure that the tip portion of any shell adjacent the table does not make interfering contact therewith. In this way inversion of the shells is not interposed with by the table surface.

Either side of the marker board in accordance with the present invention can be effectively used. Thus, if in an appropriate game, all the shells which had projected from one side of the board have been inverted through depression, the board can then be reversed and the game restarted seeing that now all the shells project out of the reverse side of the board. The board can be formed, as a single piece, of an appropriate plastic material or of natural or snythetic rubber by injection or compression molding. Alternatively, the board can be formed by sandwiching between two component portions of the frame structure a flexible sheet in which the shells have been preformed.

When the frame structure is also formed of a relatively flexible material the board as a whole can be bent or folded into a compact shape and is, therefore, amenable to being carried around in the pocket.

BRIEF DESCRIPTION OF THE DRAWINGS

For a better understanding of the present invention and to show how the same can be carried out by way of example, reference will now be made to the accompanying drawings, in which.

DETAILED DESCRIPTION

Figure 1:
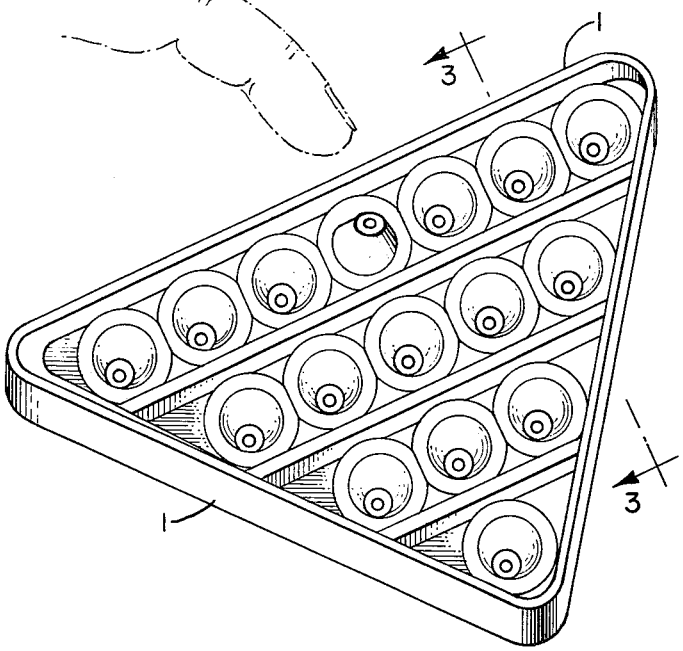
FIG. 1 is a perspective view of one form of marker board made in accordance with the present invention.
Figure 2:
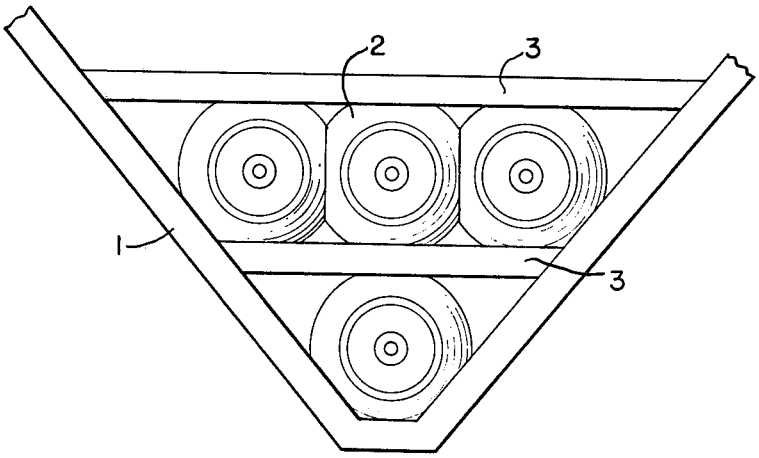
FIG. 2 is a plan view on an enlarged scale of a portion of the board shown in FIG. 1.
Figure 3:
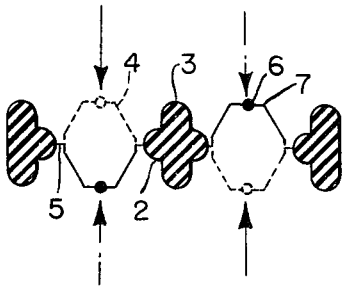
FIG. 3 is a cross-sectional view of the board shown in FIG. 1 taken along the section line 3—3 and looking in the direction of the arrows.

As seen in FIGS. 1, 2, and 3 of the drawings, the marker board, in this case forming a game board, is constituted by a frame structure, preferably, comprising a triangular perimeter frame 1; an array of annular base rings 2 located in rows, each adjacent row being formed integrally with and separated from each other by means of frame bars 3, the frame bars 3 being parallel to each other and to one side of the triangle. The base rings 2 adjacent the triangular perimeter frame 1 are formed integrally therewith.

A plurality of nipple-like or dome shaped shells 4 are respectively formed with peripheral base portions 5 which are of increased flexibility as compared with the adjacent portions of the shell, these base portions 5 being formed integrally with the surrounding ring 2. It being understood, of course, that the term "formed integrally" encompasses a connection which may be affected by bonding or the like of two materials.

Each shell 4 is formed with a circular tip portion 6 which is linked with the adjacent walls of the shell 4 by a peripheral portion 7 of increased flexibility. As can be readily seen from these FIGURES, an axial depressing force exerted on the tip portion 6 of one of the shells 4 results in its depression and inversion. The fact that the shell 4 is separated from adjacent shells 4 by the annular base rings 2 ensures that the displacement of one shell 4 does not affect the disposition of any neighboring shells 4.

The frame structure of the board is of such a spatial extent that, when the board rests on a supporting surface, the shells 4 even when inverted towards the supporting surface, are not interfered with by the surface and in this way free inversion of the shells 4 can be effected.

The fact that the shells 4 are linked to the surrounding base rings 2 by means of peripheral portions 5 of increased flexibility ensures that the depression of a shell 4 into its inverted position is not followed by the shell 4 reverting, under its own elasticity, to its original position. Similarly, the linking of the tip portions 6 of the shells 4 to the wall portions thereof by means of peripheral portions 7 of increased flexibility also ensures more complete inversion.

The marker board as shown and which, in this example, can be used for playing simple games with well known rules can suitably be formed of flexible plastics or synthetics or natural rubbers. In such cases it need only be ensured that the shells 4 are of increased flexibility as compared with the frame portion 1.

The board as shown can be appropriately formed as a single element by means of an injection or compression molding technique and suitable materials can, for example, consist of ethylene vinyl acetate, plasticized P.V.C., polyurethane and natural and synthetic rubbers.

Figure 4:
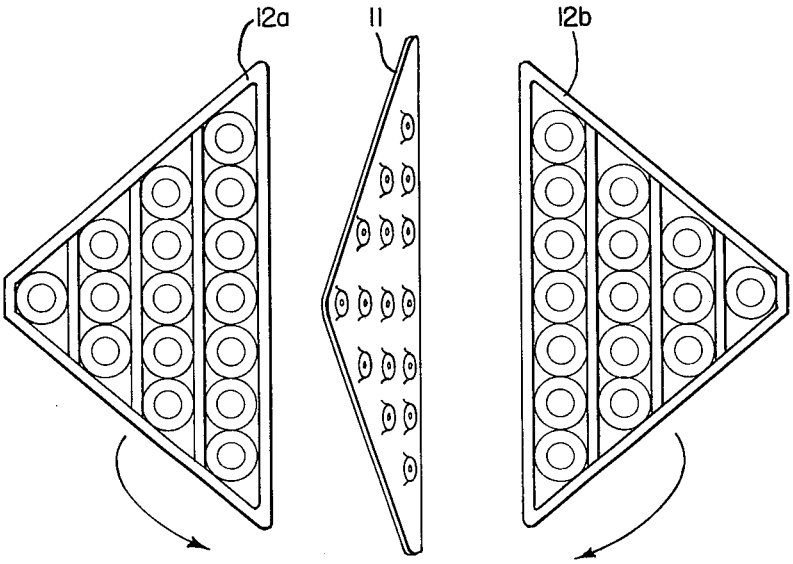
FIG. 4 shows the component portions of a marker board made in accordance with the present invention according to one form of production thereof.
Figure 5:
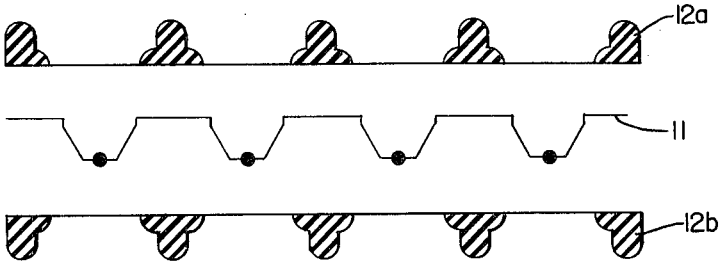
FIG. 5 is a cross-sectional view of the components as shown in FIG. 4.

FIGS. 4 and 5 of the drawings show how the board can be formed of a three component, two material system. As seen in these FIGURES, the shells can be preformed in a sheet 11, of a highly flexible material, such as, for example, latex, and this sheet 11 with the preformed shells is interposed between a pair of triangular frame structures 12*a* and 12*b,* each consisting of base rings 2, triangular perimeter frame 1, and frame bars 3. The shells 4 protrude through the base rings 2 of one or the other component. With the components located as shown in FIG. 5 of the drawings, they can then be secured together by bonding, heat welding or the like. This process has the advantage that the shells can be formed of an even more elastic material than would be possible economically if the frame structure 1 and shells 4 were to be formed of the same material. Thus, while the shells 4 can be formed of latex, and the frame structure 1 can, as before, be formed of latex or ethylene vinyl acetate, the frame structure 1 can also be formed of a more rigid material such as, for example, polystyrene.

It will be readily seen that marker boards as illustrated are capable of varied uses and, when used as a game, once all the shells have been inverted, the board can be reversed and used from the other side.

Furthermore, when the frame structure itself is of a relatively flexible construction, the board can, if desired, be folded and carried around in the pocket. The fact that the shells are formed integrally with the board means that a game which would normally require a board together with a plurality of movable pieces can be formed as one integral whole.

While the invention has been described in connection with the preferred embodiments, it is not intended to limit the invention to the particular forms set forth above, but to the contrary, it is intended to cover such alternatives, modifications, and equivalents as may be included with the spirit and scope of the invention as defined by the appended claims.

What is claimed is:

1. A marker board comprising:

a. a frame structure defining the spatial extent of the board;

b. an array of annular base rings forming at least part of said frame structure;

c. a plurality of flexible shells;

d. peripheral base portions of said shells formed respectively integrally with said rings, said shells being independently and reversibly invertible with respect to said frame structure;

e. said peripheral base portions are of increased flexibility as compared to adjacent portions of the shells; and f. respective tip portions of the shells are linked to adjacent portions of the shells by peripheral portions of increased flexibility as compared to the adjacent tip portions and are located within the spatial extent of said frame structure.

2. A marker board comprising:

a. a frame structure defining the spatial extent of the board;

b. an array of annular base rings forming at least part of said frame structure;

c. a plurality of flexible shells;

d. peripheral base portions of said shells formed respectively integrally with said rings, said shells being independently and reversibly invertible with respect to said frame structure; and e. said frame structure further comprising at least one frame bar which is formed integrally with and between an adjacent pair of rows of said rings.

* * * * *